US009284136B1

(12) United States Patent
West et al.

(10) Patent No.: US 9,284,136 B1
(45) Date of Patent: Mar. 15, 2016

(54) MEDIA GUIDE

(71) Applicant: HEWLETT-PACKARD DEVELOPMENT COMPANY, L.P., Fort Collins, CO (US)

(72) Inventors: Randall West, San Diego, CA (US); Timothy Bernier, San Diego, CA (US); Arthur G. Henschel, San Diego, CA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/572,925

(22) Filed: Dec. 17, 2014

(51) Int. Cl.

| | |
|---|---|
| ***B65H 1/04*** | (2006.01) |
| ***B65H 1/12*** | (2006.01) |
| ***B65H 9/06*** | (2006.01) |
| ***B65H 1/26*** | (2006.01) |

(52) U.S. Cl.
CPC .. *B65H 1/04* (2013.01); *B65H 1/12* (2013.01); *B65H 1/266* (2013.01); *B65H 9/06* (2013.01); *B65H 2301/363* (2013.01); *B65H 2301/4222* (2013.01); *B65H 2402/544* (2013.01); *B65H 2511/12* (2013.01)

(58) Field of Classification Search
CPC ..... B65H 1/04; B65H 1/26; B65H 1/266; B65H 2301/362; B65H 2301/363; B65H 2301/4222; B65H 2402/54; B65H 2402/544; B65H 2402/5441; B65H 2405/10; B65H 2405/11; B65H 2405/114; B65H 2405/1142; B65H 2405/11425; B65H 2405/12; B65H 2511/12; B65H 2551/11; B65H 2701/1131
See application file for complete search history.

(56) References Cited

U.S. PATENT DOCUMENTS

| | | | | |
|---|---|---|---|---|
| 4,007,925 | A * | 2/1977 | DeRyke et al. | 271/160 |
| 4,773,638 | A * | 9/1988 | Koutoudis et al. | 271/223 |
| 5,098,081 | A * | 3/1992 | DeFigueiredo | 271/240 |
| 5,685,535 | A * | 11/1997 | Michel et al. | 271/157 |
| 6,883,799 | B2 * | 4/2005 | Matsuki et al. | 271/171 |
| 7,429,041 | B2 * | 9/2008 | Yokoi | 271/162 |
| 7,753,607 | B2 | 7/2010 | Tan et al. | |
| 7,854,427 | B2 | 12/2010 | Tsujinishi | |
| 8,757,910 | B2 | 6/2014 | Kayser et al. | |
| 8,807,557 | B2 | 8/2014 | Lu et al. | |
| 2015/0021850 | A1 * | 1/2015 | Nakagawa | 271/226 |

FOREIGN PATENT DOCUMENTS

| | | |
|---|---|---|
| CN | 103522767 | 1/2014 |
| GB | 2307468 | 5/1997 |
| WO | WO-2014065759 | 5/2014 |

* cited by examiner

*Primary Examiner* — Ernesto Suarez
(74) *Attorney, Agent, or Firm* — HP Inc. Patent Department

(57) ABSTRACT

In one example an input tray is disclosed. The input tray has a support surface, at least one media guide and an over-center device. The media guide is movable between a first position and a second position. The over-center device forces the media guide towards the first position when the media guide is closer to the first position than to the second position and forces the media guide towards the second position when the media guide is closer to the second position than to the first position.

14 Claims, 7 Drawing Sheets

MEDIA GUIDE

BACKGROUND

Printers may have one or more input trays to hold blank media. Scanners and automatic document feeders (ADF) may also have an input tray to hold documents to be scanned. Both types of input trays typically have adjustable media guides for media/documents of different widths.

DETAILED DESCRIPTION

Printers, scanners and ADFs have at least one input tray to hold blank media or documents to be scanned. Most input trays can accommodate media of different widths. The media/documents in the input trays need to be aligned to the paper path to prevent miss-feeds, skewed feeds, media jams or the like. For proper alignment the front edge of the media/document should be perpendicular to the loading direction. The loading direction is the direction of motion of the media as it enters the paper path of the device (i.e. the printer, scanner or ADF).

Most input trays align the media using a pair of media guides that align the two side edges of the media parallel with the loading direction. The pair of media guides move in opposite directions when changing widths to keep the media centered in the media tray. The media guides can typically move between a number of different positions corresponding to a number of different media widths. Some media trays only have one media guide that forces the media against one side of the media tray.

Moving the media guilds to the correct position/location may not be easy. Some media guides can be positioned at any location between a maximum width and a minimum width. Other types of media guides may only have a few set positions available between the maximum width and the minimum width. Either type of media guide can be incorrectly set for the media currently loaded into the media tray. When the media guides are at a first width and media of a smaller width is loaded in the media tray, miss-feeds, skewed feeds or media jams may occur.

Some types of media guides are spring loaded towards the media in the media tray. When the spring force is too high, the side edges of the media can be bent or wrinkled which may cause miss-feeds. Increasing the width of the media guides against the force of the spring may also be difficult.

In one example, an input tray will only have two different media guide positions for two different media widths. An over-center device will force the media guide towards the first position when the media guide is closer to the first position than to the second position and will force the media guide towards the second position when the media guide is closer to the second position than to the first position.

The over-center device will snap the media guide into one of the two positions dependent on which position the media guide is closest too when a user release the guide. When a user move the media guide less than half way from one position to the other position, the over-center device will snap the media guide back into the first position. When a user move the media guide more than half way from one position to the other position, the over-center device will snap the media guide into the second position.

Figure 1:
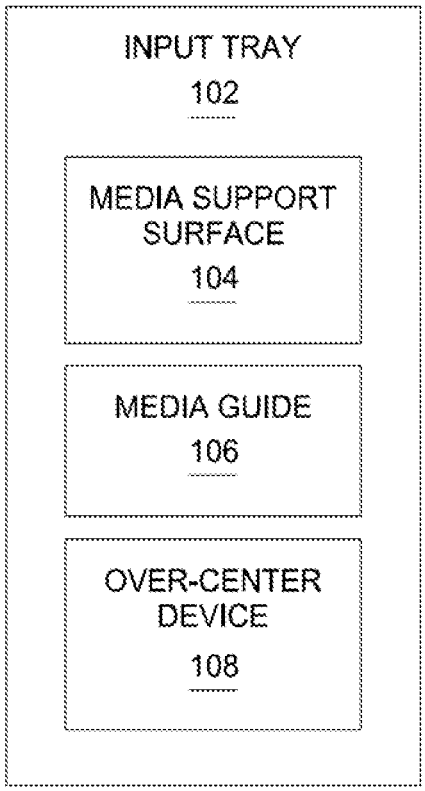
FIG. 1A is a block diagram of an example input tray.

FIG. 1 is a block diagram of an example input tray. The input tray 102 comprises a media support surface 104, a media guide 106 and an over-center device 108. The input tray 102 may also be known as an input bin, a media tray or a media bin. In this application an over-center device is defined as any mechanism that snaps between two different set positions and prevents the device from being positioned between the two different set positions.

The media support surface 104 is located in the bottom of the input tray 102 and supports media stacked in the input tray 102. The media guide 106 is positioned above the media support surface 104. Media is held between the media guide 106 and one side of the media tray 102. The media guide 106 is coupled to the over-center device 108. Therefore the media guide 106 only has two positions for two different media widths. The over-center device 108 will force the media guide 106 towards the first position when the media guide 106 is closer to the first position than to the second position and will force the media guide 106 towards the second position when the media guide 106 is closer to the second position than to the first position. In this example only one media guide 106 is shown. In other examples there may be a pair of media guides that move in opposite directions when changing widths and keep the media centered between the two media guides.

Figure 2A:
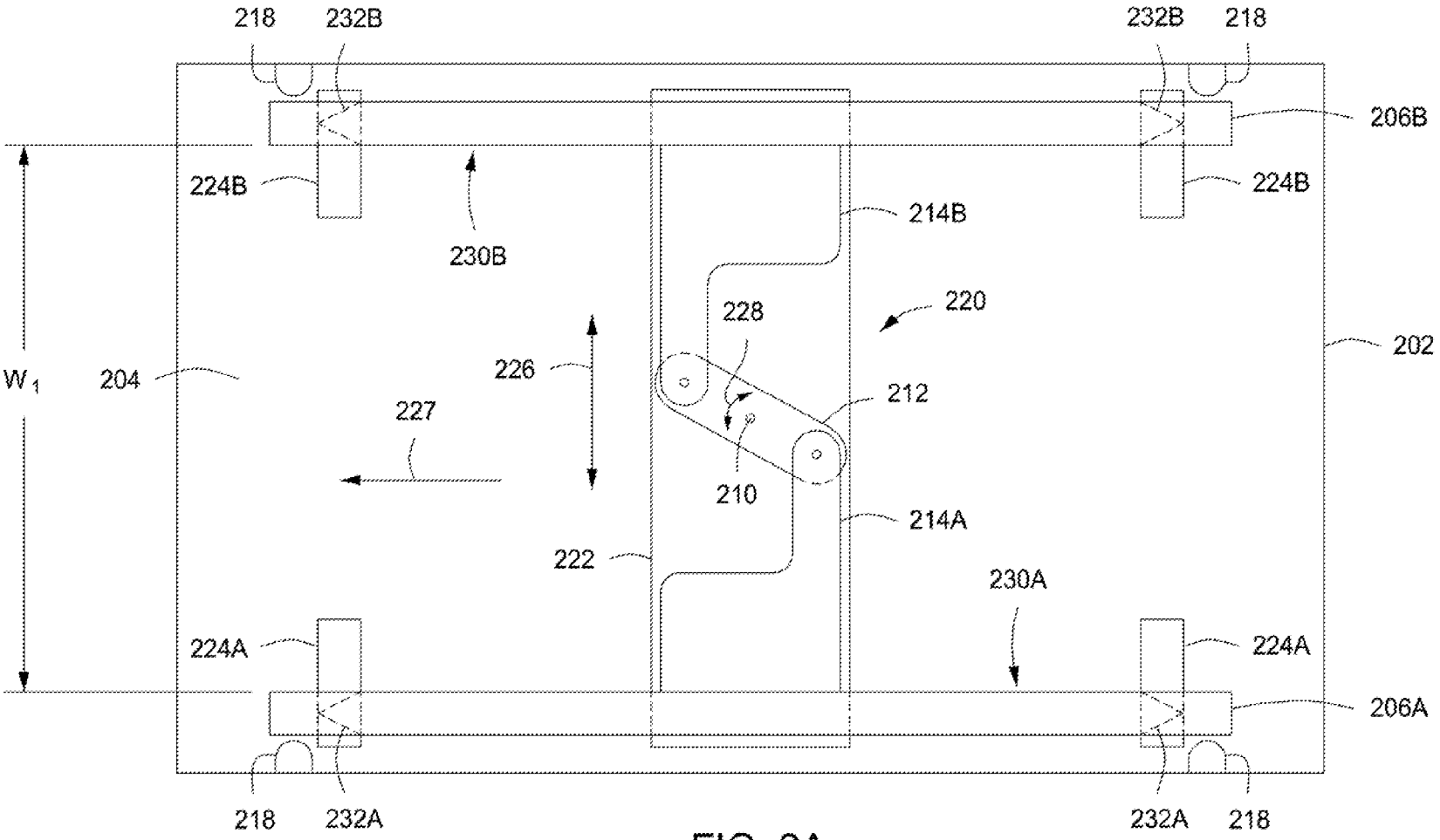
FIG. 2A is a top view of an example input tray.

FIG. 2A is a top view of an example input tray, for example the input tray from FIG. 1. In this example the input tray 202 comprises a pair of media guides (206A and 206B), a coupling device 220, a media support surface 204 and two over-center devices. The two over-center devices are not shown in this view for clarity (see FIGS. 2C and 2D for the two over-center devices). In this example the media support surface 204 is the bottom of the input tray 202.

Each media guide (206A and 206B) comprises a support arm (214A and 214B) that extends perpendicularly from the inner surface (230A and 230B) of the media guide (206A and 206B). The two support arm (214A and 214B) are positioned in a groove 222 formed in the bottom of the input tray 202. The two media guides (206A and 206B) extend above the support surface 204 and hold media between their inner surfaces (230A and 230B).

The two media guides (206A and 206B), along with their support arms (214A and 214B), can move from a first position to a second position along groove 222 (as shown by arrows 226). The two media guides (206A and 206B) move perpendicular to a loading direction (as shown by arrow 227). The loading direction is the direction of motion of media as it enters a paper path of the device (i.e. the printer, scanner or ADF). The first position (as shown) is for media of a larger width W1 and the second position is for media of a smaller width W2 (see FIG. 2B). In one example width W1 is equal to 5 inches and width W2 is equal to 4 inches. In other examples the widths may be smaller or larger.

Coupling device 220 connects the two media guides (206A and 206B) together and causes them to move the same distance but in the opposite directions in groove 222. For example, when moving from the first position into the second position, the two media guides (206A and 206B) move towards each other. In this example coupling device 220 is a bell crank 212 that rotates about axis 210 (as shown by arrow 228). The two over-center devices are forcing the two media guides away (206A and 206B) from each other when the media guides (206A and 206B) are in the second position.

Because the bell crank 212 rotates about an arc and the two support arms (214A and 214B) move in a linear direction in the groove 222, there is some clearance between the two support arms (214A and 214B) and the groove 222 and/or between where the two support arms (214A and 214B) attached to the bell crank 212 to accommodate the difference in the motions. This clearance may allow the inner surfaces (230A and 230B) of the two media guides (214A and 214B) to become miss-aligned with respect to each other when the media guides (206A and 206B) are moving between the first position and the second position.

There are two pairs of stops 218, one pair on each side of the input tray 202. The two over-center devices force each end of the two media guides (206A and 206B) against the stops 218 when the media guides (206A and 206B) are in the first position. This keeps the inner surfaces (230A and 230B) of the two media guides (214A and 214B) parallel with each other when the media guides (206A and 206B) are in the first position.

Figure 2B:
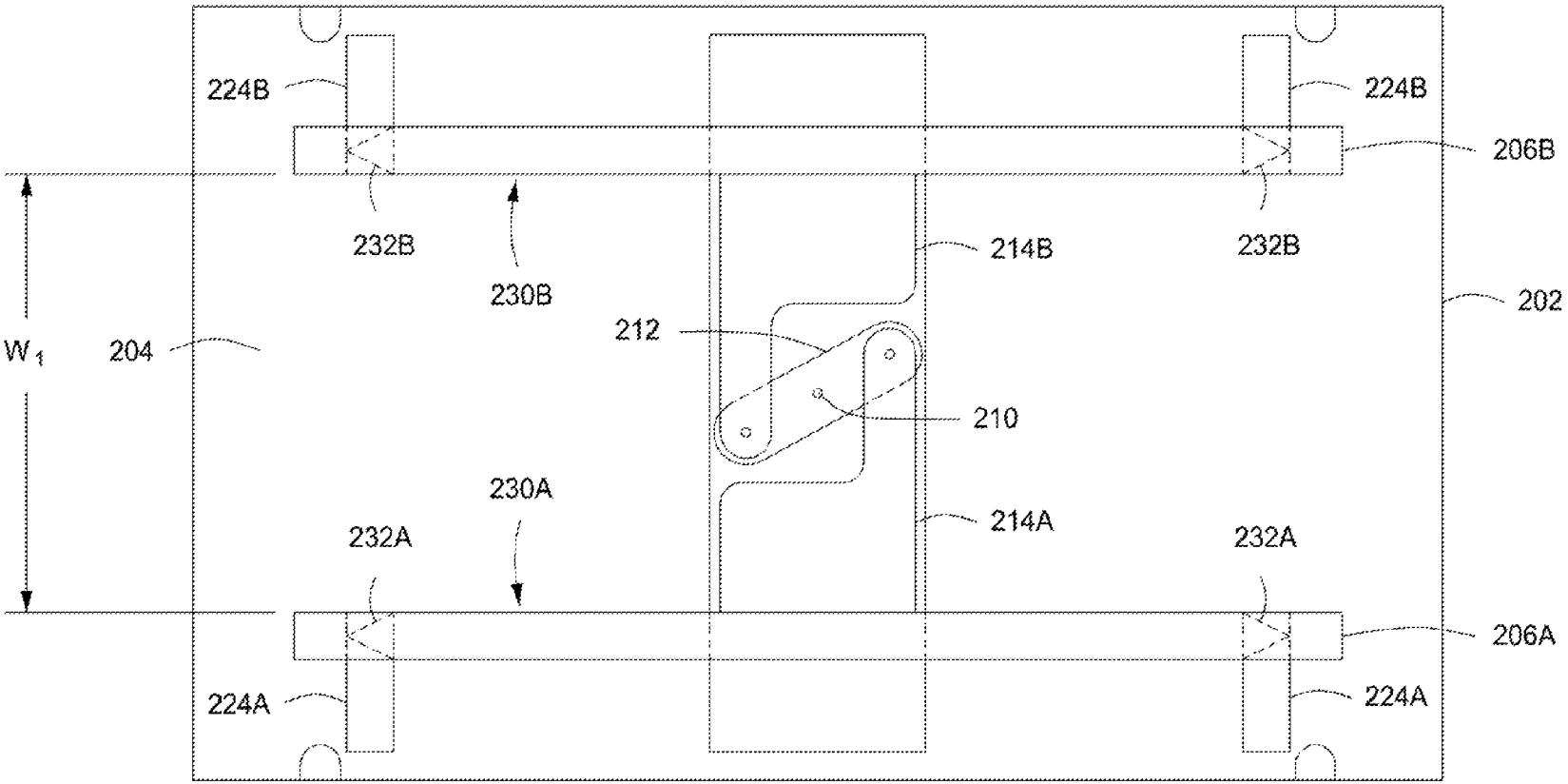
FIG. 2B is the top view of the example input tray from FIG. 2A with the media guides in the second position.

FIG. 2B is the top view of the example input tray from FIG. 2A with the media guides in the second position. The bell crank 212 has rotated about axis 210 by approximately 90 degrees, pulling the two support arms (214A and 214B) towards each other. The inner surfaces (230A and 230B) of the two media guides (206A and 206B) are now separated by width W2. The two over-center devices are forcing the two media guides (206A and 206B) towards each other when the media guides (206A and 206B) are in the second position.

The input tray 202 has 2 pair of slots (224A and 224B) formed in the bottom surface with a slot (224A and 224B) located underneath each end of the media guides (206A and 206B). Each end of the two media guides (206A and 206B) has a mount (232A and 232B) that extends from the bottom of the media guide (206A and 206B) through the slot (224A and 224B). The mounts (232A and 232B) couple the two over-center devices to the media guides (206A and 206B) (see FIG. 2C for a view including the over-center devices).

Figure 2C:
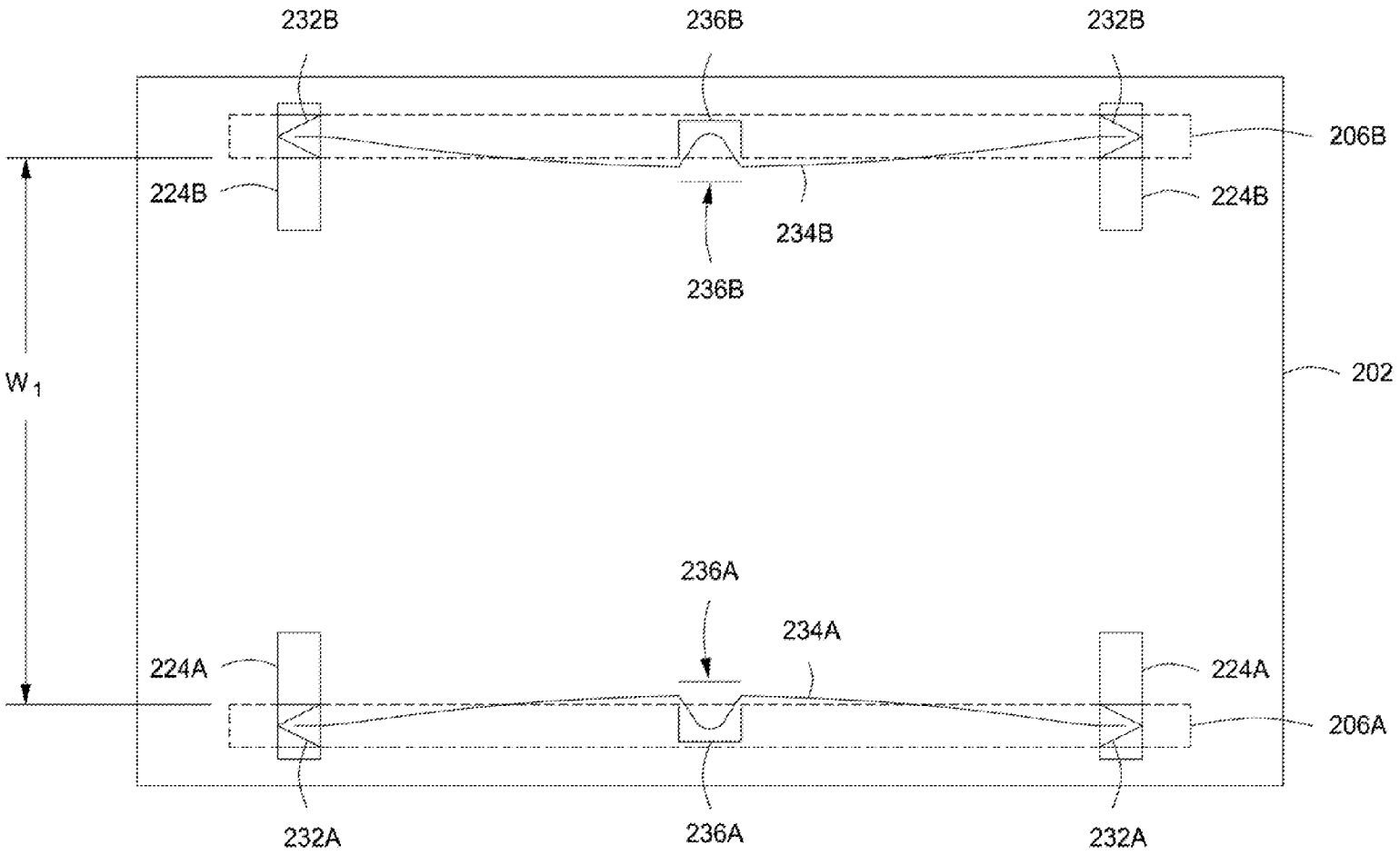
FIG. 2C is a bottom view of the example input tray of FIG. 2A.

FIG. 2C is a bottom view of the example input tray of FIG. 2A. The two media guides (206A and 206B) are in the first position with a width of W1 between the two media guides (206A and 206B). The two support arms (214A and 214B) and the bell crank 212 are not shown in this view for clarity. In this example the two over-center devices are two leaf springs (234A and 234B). The middle sections of the two leaf springs (234A and 234B) are held on the bottom of the input tray 202 by middle mounts 236A and 236B. The ends of the two leaf springs (234A and 234B) are inserted into a pair of mounts (232A and 232B) with one mount formed on each end of the media guides (206A and 206B). The mounts (232A and 232B) extend from the media guides (206A and 206B) though the slots (224A and 224B) in the bottom of the input tray 202.

In this example, the middle sections of the two leaf springs (234A and 234B) are attached to the bottom of the input tray 202 and the two ends of the leaf springs (234A and 234B) are attached to the media guides (206A and 206B). In other examples the middle of the leaf springs (234A and 234B) may be attached to the media guides (206A and 206B) and the two ends of the leaf springs (234A and 234B) may be attached to the bottom of the input tray 202.

In this example the mounts (232A and 232B) are 'V' shaped but in other examples other shapes may be used. The tips of the leaf springs (234A and 234B) fit into the 'V' shape, holding the leaf springs (234A and 234B) in place. The distance between each pair of 'V' shaped mounts is selected such that the leaf springs (234A and 234B) are compressed once they are loaded into the mounts (232A and 232B). Because the leaf springs (234A and 234B) are compressed, the leaf springs (234A and 234B) will be buckled in one direction when the media guides (206A and 206B) are in the first position (as shown in FIG. 2C) and will buckle in the other direction when the media guides (206A and 206B) are in the second position (see FIG. 2D). When the media guides (206A and 206B) are in the first position (as shown in FIG. 2C) the leaf springs (234A and 234B) are forcing the two media guides (206A and 206B) away from each other.

Figure 2D:
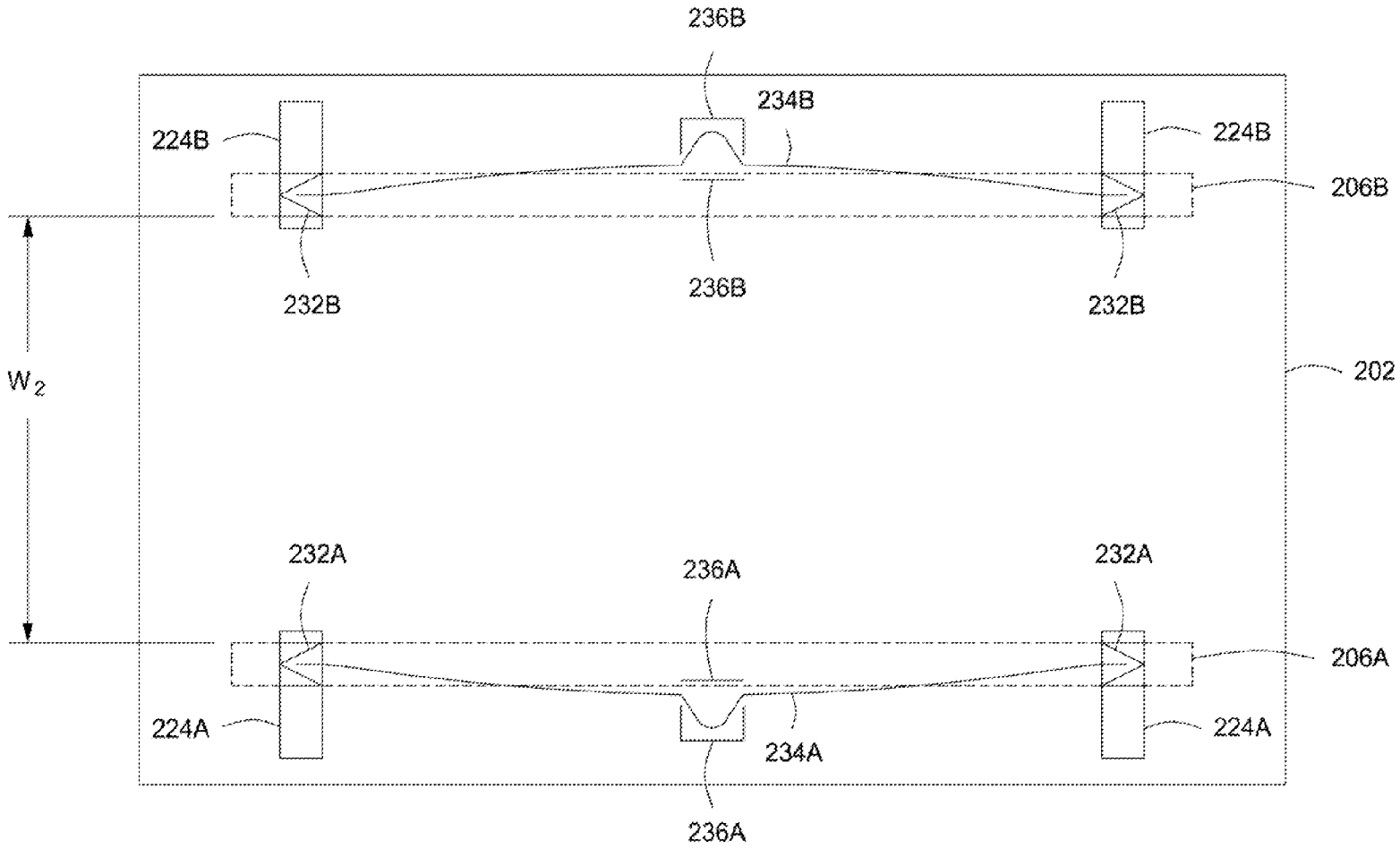
FIG. 2D is a bottom view of the example input tray of FIG. 2A with the media guides in the second position.

FIG. 2D is a bottom view of the example input tray of FIG. 2A with the media guides (206A and 206B) in the second position. The two support arms (214A and 214B) and the bell crank 212 are not shown in this view for clarity. When the media guides (206A and 206B) are in the second position (as shown in FIG. 2D) the leaf springs (234A and 234B) are forcing the two media guides (206A and 206B) towards each other. In one example the ends of the slots (224A and 224B) act as hard stops for the media guides (206A and 206B) when the media guides (206A and 20680 are in the second position. The ends of the slots (224A and 224B) limit the travel of the media guides (206A and 206B0 by contacting the edge of the 'V' shaped mounts (232A and 232B). In other examples different stops may be used. Because the leaf springs (234A and 234B) force the media guides (206A and 206B0 against the hard stops when the media guides (206A and 206B) are in the second position, the media guides (206A and 206B0 are held parallel with each other in the second position.

Figure 3:
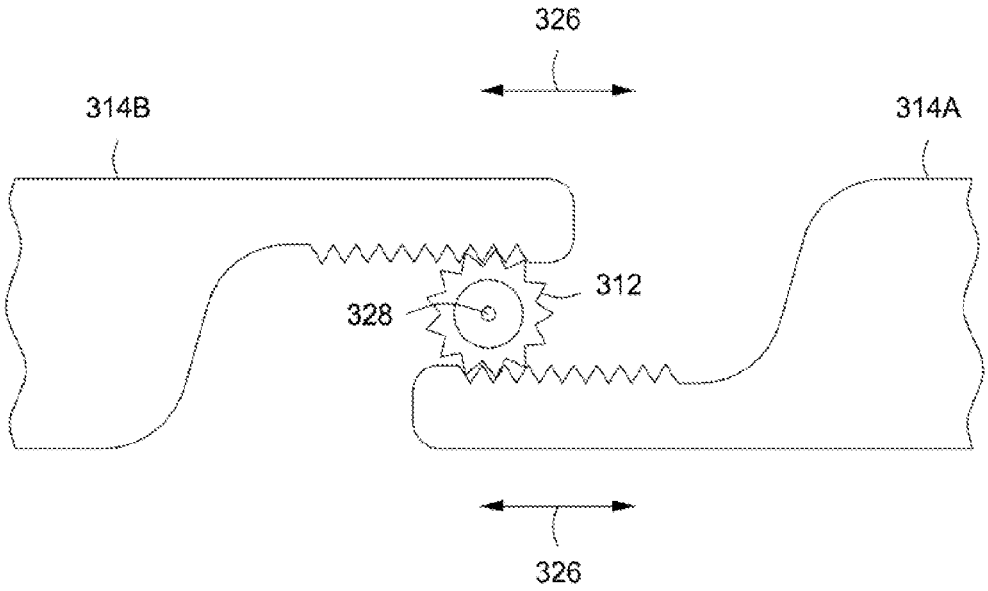
FIG. 3 is a partial top view of another example coupling device.

In the example describe above, the coupling device 220 between the two media guides (206A and 206B) was a bell crank 212. In other examples, other types of coupling devices may be used in the input tray 202. FIG. 3 is a partial top view of another example coupling device. In this example the coupling device is a rack and pinion gear train. Each support arm (314A and 314B) has a gear rack formed along one side of the tip of the support arm. The gear racks interface with opposite sides of the pinion gear 312 such that a rotation of the pinion gear about the axis of rotation 328 causes the two support arms (314A and 314B) to move in opposite directions along an axis of motion as shown by arrow 326.

A rack and pinion coupling device does not need as much clearance between the support arms (314A and 314B) and the groove 222 in the input tray 202 as a bell crank 212. With tighter tolerances between the support arms (314A and 314B) and the groove 222 in the input tray 202, the inner surfaces (230A and 230B) of the media guides (206A and 206B) may remain parallel with each other even when the media guides (206A and 206B) are moving between the two positions. Therefore when using this type of a coupling device, hard stops may not be needed at the two different positions of the media guides (206A and 206B).

Figure 4:
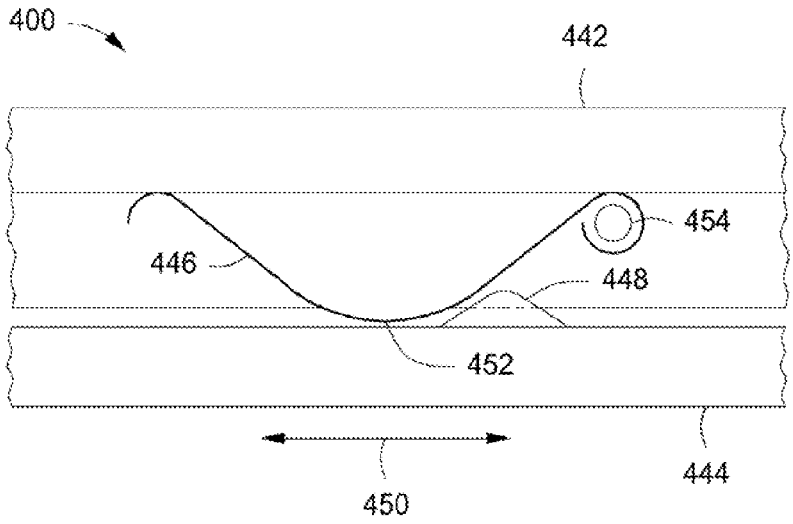
FIG. 4 is a top view of another example over-center device.

In the examples describe above the over-center devices are leaf springs (234A and 234B). Other types of over-center devices may be used in the input tray 202. FIG. 4 is a top view of another example over-center device. The over-center device 400 comprises a frame 442, a spring 446 and a slide 444. The slide 444 is mounted adjacent to the frame 442 and can move in an axis of motion as shown by arrow 450. The slide 444 is constrained from movement perpendicular to the axis of motion. The spring 446 is mounted on a pin 454 in a channel formed in frame 442. The spring 446 is shaped like a 'U' with a bottom point near the slide 444. A 'V' shaped mound 448 is formed on the slide 444 with the point of the 'V' facing the spring 446.

The slide 444 can move between two positions. The first position is where the mound 448 is on the right side of the high point of the spring (as shown). The second position is where the mound 448 is on the left side of the spring high point. As the slide is moved towards the left (in the current view) the mound 448 begins to compress the spring 446. The force generated by the compress spring 446 acts to force the slide 444 back towards the first position until the tip of the mound 448 passes to the left of the high point 452 of the spring 446. Once the tip of the mound 448 passes to the left of the high point 452 of the spring 446, the force of the spring 446 forces the slide towards the second position.

The over-center device shown in FIG. 4 uses a linear motion to snap between the two positions. In other examples the over-center device may snap between two angular positions. For example the over-center device may act to snap the pinion gear in FIG. 3 between two angular positions.

Figure 5:
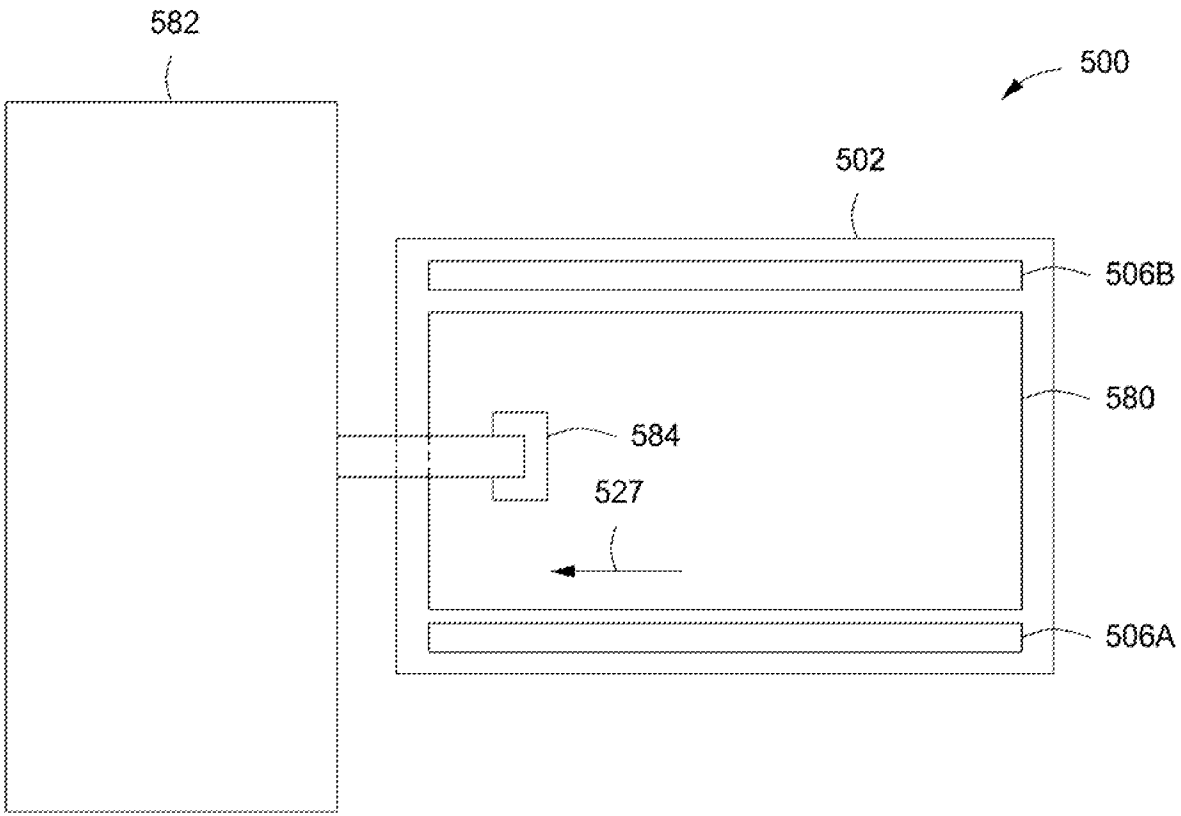
FIG. 5 is a top view of an example device.

FIG. 5 is a top view of an example device. Example device 500 comprises a device body 582, a pick wheel 584 and an input tray 502, for example the input tray of FIG. 1 or FIG. 2. In this example the input tray 502 is adjacent to the device body 582, but in other examples the input tray 502 may be held inside the device body 582. The input tray has a pair of media guides (506A and 506B) that are coupled to an over-center device (not shown for clarity). The over-center device constrains the pair of media guides into two positions. The over-center device snaps the pair of media guides between the two positions and helps prevent the media guides from being located between the two positions.

A stack of media or a document 580 is shown loaded into the input tray 502. The pick wheel 584 is positioned over the input tray and moves the top page of media/document in a loading direction (as shown by arrow 527) towards device body 582. The loading direction is parallel with a paper path inside the device 500. Device 500 may be a printer, an automatic document feeder (ADF) a scanner or the like.

What is claimed is:

1. An input tray, comprising:

a support surface to hold a stack of media;

at least one media guide positioned on top of the support surface and movable between a first position and a second position, the first position for media of a first width and the second position for media of a second, different width;

a second media guide movable between a third position and a fourth position, the second media guide attached to the at least one media guide with a coupling device such that the second media guide moves in an opposite direction from the at least one media guide when the at least one media guide moves between the first position and the second position; and a first over-center device mounted to the input tray and coupled to the at least one media guide to force the at least one media guide towards the first position when the at least one media guide is closer to the first position than to the second position and to force the at least one media guide towards the second position when the at least one media guide is closer to the second position than to the first position.

2. The input tray of claim 1, wherein the first over-center device comprises:

a leaf spring, the leaf spring held in a compressed state and buckled in a first direction when the at least one media guide is in the first position and buckled in a second, opposite direction when the at least one media device is in the second position.

3. The input tray of claim 1, wherein the first over-center device comprises:

a spring bent into a 'U' shape and attached to a frame, the two ends of the 'U' adjacent to a top edge of the frame and the bottom of the 'U' adjacent to a slide;

a 'V' shaped mound on the slide with the point of the 'v' facing the top edge of the frame;

the slide movable along an axis parallel with the top edge of the frame between a first position with the mound on one side of the spring and a second position with the mound on the other side of the spring; and wherein the mound compresses the spring when moving between the first and second positions.

4. The input tray of claim 1, wherein the coupling device comprises:

a bell crank.

5. The input tray of claim 1, further comprising:

a second over-center device mounted to the input tray and coupled to the second media guide to force the second media guide towards the third position when the second media guide is closer to the third position than to the fourth position and to force the second media guide towards the fourth position when the second media guide is closer to the fourth position than to the third position.

6. The input tray of claim 1, further comprising:

a hard stop located in the input tray wherein the first over-center device acts to force the at least one media guide against the hard stop when the media guide is in the first position.

7. The input tray of claim 1, wherein the media of the first width is 5 inches wide and the media of the second width is 4 inches wide.

8. A device, comprising:

at least one input tray to support a stack of media sheets;

a pair of media guides positioned in the at least one input tray and movable between respective first and second positions, the first position for media of a first width and the second position for media of a second, different width;

a coupling device connecting the pair of media guides together such that the pair of media guides move towards or apart from each other when moving between the respective first and second positions;

at least one over-center device coupled to one of the pair of media guides, the at least one over-center device to force the pair of media guides apart when the pair of media guides are in the first position and to force the pair of media guides together when the pair of media guides are in the second position.

9. The device of claim 8, wherein the over-center device comprises:

a leaf spring held in a compressed position such that the leaf spring is buckled in a first direction when the pair of media guides are in the first position and the leaf spring is buckled in a second, opposite direction when the pair of media guides are in the second position.

10. The device of claim 8, wherein the coupling device includes at least one of a bell crank, and a rack and pinion gear.

11. The device of claim 8, wherein the device is selected from the following group of devices comprising: a printer, a scanner and an automatic document feeder (ADF).

12. The device of claim 8, wherein the media of the first width is 5 inches wide and the media of the second width is 4 inches wide.

13. A method of adjusting a media guide, comprising:

moving the media guide, against a spring force acting in a first direction, from a first position for a first media width towards a second position for a second, different media width;

wherein the media guide is coupled to a second media guide that is movable between a third position and a fourth position, the second media guide being attached to the first media guide with a coupling device such that the second media guide moves in an opposite direction from the first media guide when the first media guide moves between the first position and the second position; and switching the action of the spring force to a second direction, opposite the first direction, using an over-center device, when the media guide reaches a location closer to the second positions than to the first position.

14. The method of claim 13, wherein the over-center device comprises:

at least one leaf spring held in a compressed position such that the leaf spring is buckled in a first direction when the media guide is in the first position and the leaf spring is buckled in a second, opposite direction when the media guide is in the second position.

* * * * *